US006414434B1

(12) United States Patent
Nakano et al.

(10) Patent No.: US 6,414,434 B1
(45) Date of Patent: Jul. 2, 2002

(54) PLASMA DISPLAY PANEL HAVING FIRST AND SECOND PARTITION WALLS

(75) Inventors: Takashi Nakano; Masaomi Ebe, both of Yamanashi (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/349,363

(22) Filed: Jul. 8, 1999

(30) Foreign Application Priority Data

Jul. 15, 1998 (JP) ..... 10-216463

(51) Int. Cl.[7] ..... H01J 17/49

(52) U.S. Cl. ..... 313/582; 313/493; 313/609; 445/43

(58) Field of Search ..... 313/581, 582, 313/583, 584, 585, 586, 609, 495, 484, 493, 610; 445/24, 42, 43

(56) References Cited

U.S. PATENT DOCUMENTS 5,754,003 A * 5/1998 Murai et al. ..... 313/582
5,846,110 A * 12/1998 Kanagu et al. ..... 445/25
5,883,462 A * 3/1999 Ushifusa et al. ..... 313/292
5,894,193 A * 4/1999 Amrine et al. ..... 313/481
6,236,159 B1 * 5/2001 Inoue et al. ..... 313/493

* cited by examiner

*Primary Examiner*—Nimeshkumar D. Patel
*Assistant Examiner*—Karabi Guharay
(74) *Attorney, Agent, or Firm*—Sughrue Mion, PLLC

(57) ABSTRACT

A plasma display panel such that a sealing layer 10 is used for sealing the peripheral edge portions of a pair of glass substrates 1 and 3 and that first partition walls 6 for respectively providing discharge spaces 7 in a display area 9 between the glass substrates 1 and 3. A second partition wall 11 is so disposed as to surround the display area 9 inside the sealing layer 10 and is brought into intimate contact with the pair of glass substrates 1 and 3.

7 Claims, 3 Drawing Sheets

PLASMA DISPLAY PANEL HAVING FIRST AND SECOND PARTITION WALLS

BACKGROUND OF THE INVENTION

1. Field of the Invention

This invention relates to a spontaneous light-emission-type plasma display panel (PDP) using a gas discharge.

2. Description of the Related Art

Recently, it has been anticipated to put into practical use a plasma display panel of surface-discharge-type alternating-current driving system as a large-sized, thin color display unit.

FIG. 4 shows an example of the structure of a plasma display panel of alternating-current driving system, which will now be described with reference to the drawing.

As shown in FIG. 4, a plurality of pairs of line electrodes X and Y disposed in parallel to each other are formed on a glass substrate 1 on a display surface side, the line electrodes including transparent conductive films as transparent electrodes, and metal electrodes in the form of metal films stacked up in end portions opposite to the discharge gaps of the respective transparent conductive films and used for supplementing the conductivity of the transparent electrodes. Further, a dielectric layer 2 is formed so as to cover the line electrodes X and Y, and a protective layer (not shown) of MgO is also formed on the dielectric layer 2.

On the inner surface of a back-side glass substrate 3 lie a plurality of column electrodes 4 disposed with a predetermined space held therebetween in such a way as to cross the pairs of line electrodes X and Y at right angles, and an electrode protective layer 5 for covering the column electrodes 4. Further, a belt-like rib (partition wall) 6 having a predetermined height is provided between the column electrodes 4 of the back-side glass substrate 3, whereby a discharge space 7 is formed in each unit luminous area in the direction of a display line to define the gap dimension of the discharge space 7. Moreover, fluorescent material layers of three colors R, G and B are provided above the surfaces of the column electrodes 4 of the back-side glass substrate 3, and the sides of the ribs 6, respectively.

A process of making the plasma display panel comprises the steps of placing the aforementioned component elements on the respective glass substrates, applying frit paste containing low-melting glass powder as the main ingredient so that a display area is surrounded with the paste in one outer peripheral non-display area of the glass substrate, and temporarily calcining the paste in order to form a sealing layer 10 first.

In such a state that both the glass substrates have been combined together and temporarily fixed, the combination is then subjected to heat treatment at about 400° C. so as to fusion-bond the two sheets of glass substrates 1 and 3 using the sealing layer 10. Subsequently, the interior space is evacuated and also a rare gas is encapsulated therein.

Since the frit paste containing the low-melting glass powder as the main ingredient is employed for the sealing layer 10 used to seal the peripheries of the two sheets of glass substrates 1 and 3 in the conventional plasma display panel, the generation of thermal decomposition gas tends to become greater when the peripheries thereof are sealed through the heat treatment. Consequently, the residual moisture and impure gases such as carbon dioxide and the like left or adsorbed by the sealing layer 10 are exhausted through the heat treatment at a predetermined temperature during the step of evacuation. However, the problem is that the impure gases diffused in the discharge spaces may contaminate the protective film used to cover the dielectric layer 2 and this results in making discharge characteristics unstable.

SUMMARY OF THE INVENTION

The present invention has been made to solve the above problem with the prior art, and therefore an object of the present invention is to provide a plasma display panel with improved reliability.

To achieve the above object, according to the present invention, there is provided a plasma display panel wherein a sealing layer is used for sealing the peripheral edge portions of a pair of glass substrates and wherein first partition walls for respectively providing discharge spaces in a display area between the glass substrates, is characterized by providing a second partition wall which is so disposed as to surround the display area inside the sealing layer and is brought into intimate contact with the pair of glass substrates.

In the plasma display panel, the first and second partition walls are formed by simultaneously patterning low-melting glass layers formed on the respective glass substrates according to the respective patterns.

The plasma display panel is arranged so that the first partition walls for partitioning the display area into discharge spaces in between the glass substrates, and the second partition wall kept in close contact with the pair of glass substrates is provided in such a way as to surround the display area, so that the display area remains unaffected by the formation of the sealing layer in the peripheral edge portion of the glass substrate.

Since the first and second partition walls are formed by simultaneously patterning the low-melting glass layers formed on the respective glass substrates according to the respective patterns, moreover, the steps of forming these partition walls can be carried out efficiently and simplified at the same time.

DETAILED DESCRIPTION OF THE PREFERRED EMBODIMENTS

An embodiment of the present invention will now be described with reference to the drawings.

Figure 1:
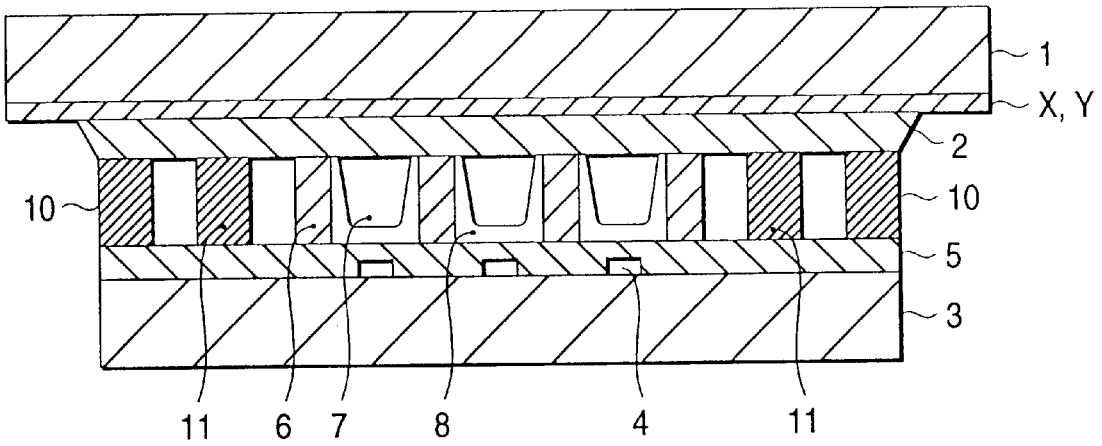
FIG. 1 is a sectional view of a surface discharge type plasma display panel embodying the present invention.
Figure 2:
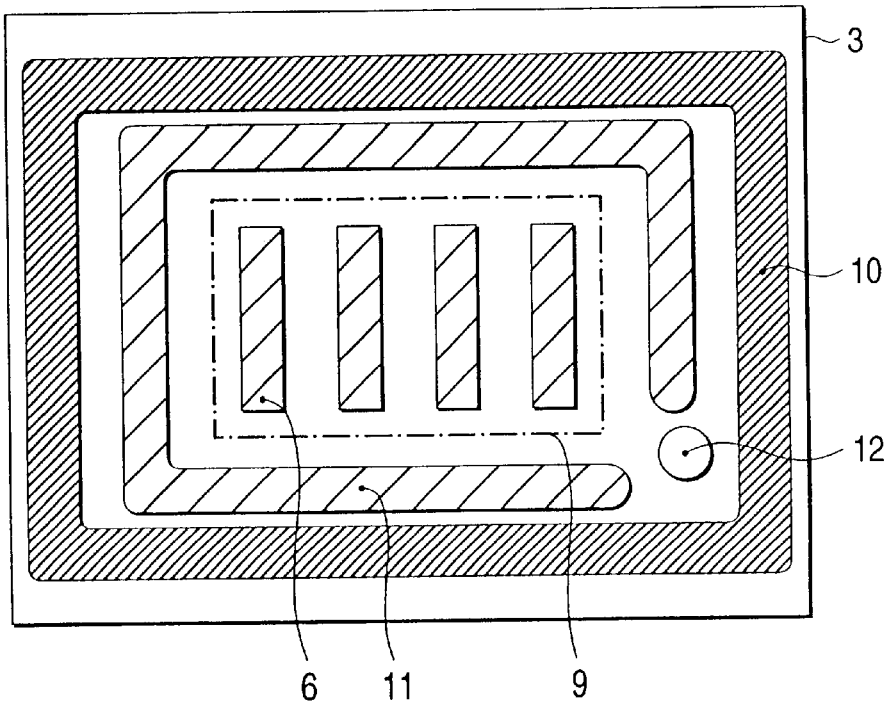
FIG. 2 is a plan view of the back-side glass substrate of FIG. 1.
Figure 4:
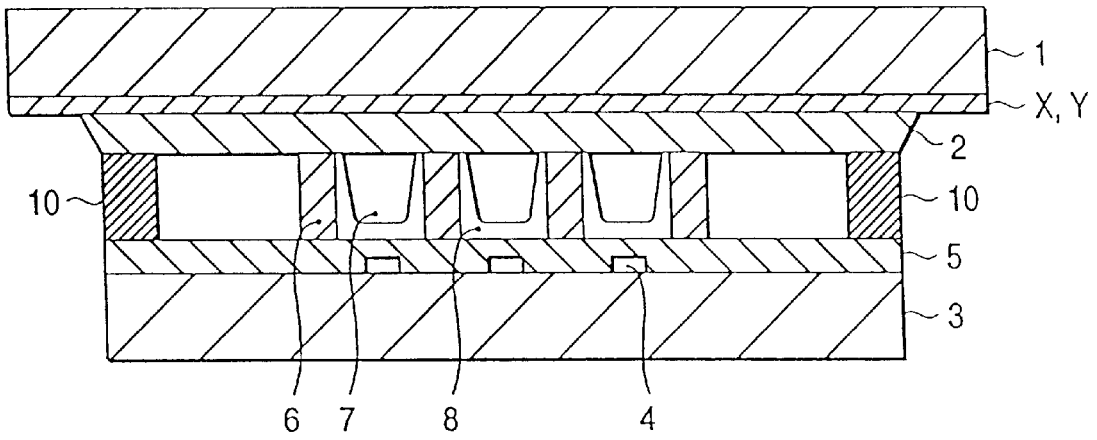
FIG. 4 PRIOR ART
FIG. 4 is a sectional view illustrating the sealing structure of a conventional plasma display panel.

FIG. 1 is a sectional view of a plasma display panel embodying the present invention; and FIG. 2, a plan view of a back-side glass substrate. In FIGS. 1 and 2, like reference characters designate like component elements corresponding to FIG. 4.

As shown in FIGS. 1 and 2, a plurality of pairs of line electrodes X and Y for surface discharging are formed on the inner surface of a glass substrate 1 on a display surface side by stacking transparent electrodes and metal electrodes in the form of thick films for reducing resistance like the arrangement made for the aforementioned convention al example. A dielectric layer 2 made of low-melting glass and used for covering the line electrodes X and Y, and a protective layer (not shown) in the form of a magnesium oxide (MgO) film are successively formed on the line electrodes in this order.

On the inner surface side of a back-side glass substrate 3 exist a plurality of column electrodes 4 disposed with a predetermined space held therebetween in such a way as to cross the pairs of line electrodes X and Y at right angles, and an electrode protective layer 5 for covering the column electrodes 4. Further, a belt-like rib (partition wall) 6 having a predetermined height is provided between the column electrodes 4 of the back-side glass substrate 3, whereby discharge spaces 7 are formed in the display area 9.

As shown in FIG. 2, a sealing layer 10 is provided in a outer peripheral non-display area of the back-side glass substrate 3 and a frame-like second partition wall 11 is also provided inside in such a way as to surround the display area 9. The second partition wall 11 provided inside is formed by patterning a low-melting glass layer made of the same first glass material as what is used to make the partition walls 6 as will be described hereinafter.

On the other hand, the sealing layer 10 is formed by applying frit paste containing low-melting glass powder made of a second glass material whose softening point is lower than that of the first glass material, and a mixture of a binder (resin) and a solvent, and temporarily calcining the frit paste. Both the glass substrates 1 and 3 are then stacked, temporarily fixed and heated at about 350–450° C. for several ten minutes, so that the peripheries of the two sheets of glass substrates 1 and 3 are hermetically sealed by fusion-bonding the sealing layer 10. In this case, a cutout is provided in the second partition wall 11 of the back-side glass substrate 3, and an exhaust and gas-encapsulating hole 12 is provided in the non-display area between the sealing layer 10 and the second partition wall 11. The interior space is evacuated and a rare gas is also encapsulated therein.

A process of forming each of the partition walls 6, and the sealing layer 10 shown in FIGS. 1 and 2 will subsequently be described by reference to FIGS. 3A to 3D.

Figure 3A:
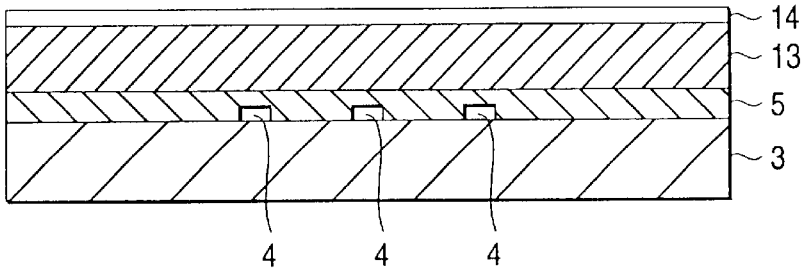
FIGS. 3A to 3D are sectional views illustrating the steps of forming partition walls and a sealing layer on the back-side glass substrate of FIG. 1.

(1) As shown in FIG. 3A, thin Al films as the column electrodes 4 are first formed at predetermined intervals on the back-side glass substrate 3. Then low-melting glass paste is uniformly applied by screen printing onto the back-side glass substrate 3 including the column electrodes 4 to form the electrode protective layer 5 formed of the low-melting glass layer and heat-calcining the paste to form the electrode protective layer 5 formed of the low-melting glass layer.

(2) Subsequently, low-melting glass paste containing the first glass material as the main ingredient is uniformly applied by screen printing onto the surface of the electrode protective layer 5 in such a way as to cover the surface thereof before being heat-dried in order to form a glass layer 13 for use in forming the first partition walls 6 and the second partition wall 11. Then a photoresist layer 14 in the form of a sandblast-resistant film is stacked on the glass layer 13.

Figure 3B:
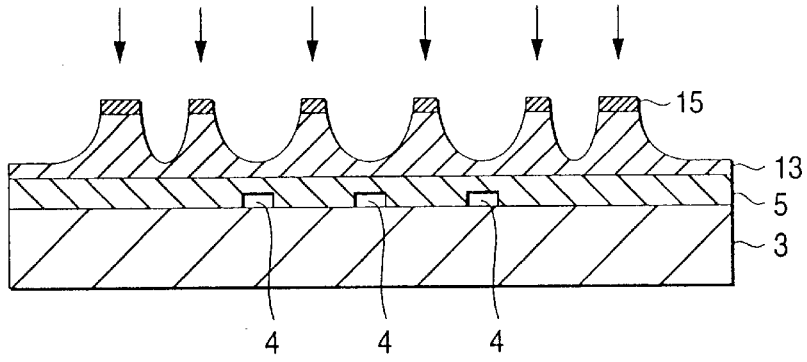

(3) The photoresist layer 14 is exposed to light and developed according to the patterns of the first and second partition walls 6 and 11 and as shown in FIG. 3B, the glass layer 13 is selectively patterned through the sandblasting process via a resist mask 15 after the resist mask 15 thus patterned is formed.

Figure 3C:
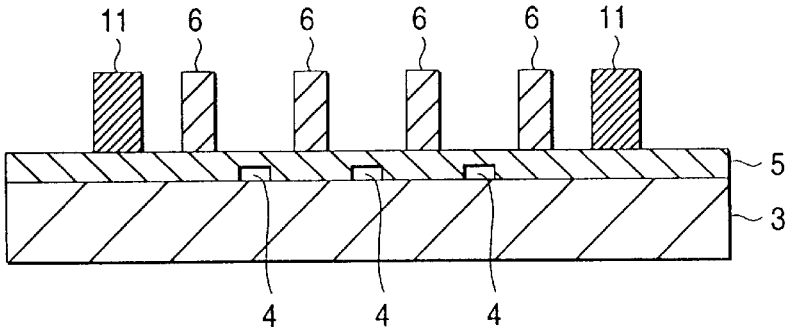

(4) As shown in FIG. 3C then, by heat-calcining the glass layer 13 thus patterned at 450–550° C., it is possible to efficiently form the belt-like first partition wall 6 used to form the discharge space 7 between the column electrodes 4 in each corresponding unit luminous area simultaneously with the frame-like second partition wall 11 having the cutout in the peripheral edge portion of the back-side glass substrate 3.

Figure 3D:
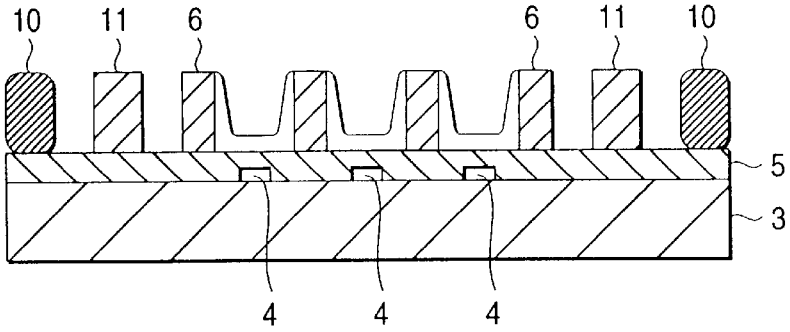

(5) As shown in FIG. 3D further, a fluorescent material layer 8 is provided in such a way as to cover the surface of the electrode protective layer 5 on each column electrode 4 and the sides of the first partition walls 6. Further, frit paste containing the second glass material whose softening point is lower than that of the first glass material used to form the first and second partition walls 6 and 11 is applied to the outer side of the second partition wall 11 in a frame-like form before being temporarily calcined to form the sealing layer 10.

(6) Further, the two sheets of glass substrates 1 and 3 are stacked and temporarily fixed before being heated at 350–450° C. The peripheries of the two sheets of glass substrates 1 and 3 are fusion bonded together and hermetically sealed by the sealing layer 10. Then a plasma display panel is completed by evacuating the interior space and encapsulating a rare gas therein.

As set forth above, the moisture and impure gases such as carbon dioxide and the like left in or adsorbed by the sealing layer 10 are exhausted through the heat treatment and also restrained by the second partition wall 11, with the result that the reliability of the plasma display panel is improved.

What is claimed is:

1. A plasma display panel, comprising:

a pair of glass substrates;

a sealing layer for sealing the peripheral edge portions of said glass substrates;

first partition walls for respectfully providing discharge spaces in a display area between said glass substrates;

a second partition wall disposed to surround the display area inside said sealing layer and is brought into intimate contact with said glass substrates; and an exhaust hole provided in a non-display area between said sealing layer and said second partition wall.

2. A plasma display panel as claimed in claim 1, wherein said first and second partition walls comprise simultaneously patterning glass layers formed on the respective glass substrates according to the respective patterns.

3. A plasma display panel as claimed in claim 1, wherein said exhaust hole is an exhaust and gas-encapsulating hole.

4. A plasma display panel as claimed in claim 1, wherein said second partition wall is formed from a first glass material and said sealing layer is formed from a second glass material, and wherein a softening point of said second glass material is lower than a softening point of said first glass material.

5. A plasma display panel as claimed in claim 4, wherein said first partition walls are formed from said first glass material.

6. A plasma display panel comprising:

a first substrate and a second substrate;

a sealing layer for sealing a sealed area between said first substrate and said second substrate;

first partition walls that define discharge spaces in a display area within said sealed area;

a second partition wall which is disposed inside said sealing layer in said sealed area, which substantially surrounds the display area, and which at least indirectly contact said first substrate and said second substrate; and an exhaust hole provided in a non-display area between said sealing layer and said second partition wall;

wherein said second partition wall is formed from a first material and said sealing layer is formed from a second material, and wherein a softening point of said second material is lower than a softening point of said first material.

7. A plasma display panel as claimed in claim 7, wherein said exhaust hole is an exhaust and gas-encapsulating hole.

* * * * *